US008622229B2

(12) United States Patent
Lane

(10) Patent No.: US 8,622,229 B2
(45) Date of Patent: Jan. 7, 2014

(54) BEVERAGE BOTTLE AND LID WITH BACK BUTTON RELEASE AND BUTTON LOCK

(75) Inventor: Marvin Lane, Round Lake Beach, IL (US)

(73) Assignee: Thermos, L.L.C., Schaumburg, IL (US)

( * ) Notice: Subject to any disclaimer, the term of this patent is extended or adjusted under 35 U.S.C. 154(b) by 0 days.

(21) Appl. No.: 13/483,972

(22) Filed: May 30, 2012

(65) Prior Publication Data

US 2013/0319966 A1 Dec. 5, 2013

(51) Int. Cl.
*B65D 41/62* (2006.01)
*B65D 43/00* (2006.01)
*B65D 47/08* (2006.01)

(52) U.S. Cl.
USPC ..... 215/305; 215/245; 215/388; 220/254.5; 220/326; 220/827

(58) Field of Classification Search
USPC ..... 215/245, 388, 228, 387, 305; 220/252, 220/254.1, 254.5, 254.7, 323, 326, 827, 220/715; 222/556
See application file for complete search history.

(56) References Cited

U.S. PATENT DOCUMENTS 7,467,727 B2 * 12/2008 Yuhara ..... 220/4.22
8,141,731 B2 * 3/2012 Mazurkiewicz et al. ..... 215/237
2012/0312832 A1 * 12/2012 Lane ..... 220/833

* cited by examiner

*Primary Examiner* — Anthony Stashick
*Assistant Examiner* — Jennifer Castriotta
(74) *Attorney, Agent, or Firm* — Schiff Hardin LLP

(57) ABSTRACT

A drink bottle with a removable lid includes an inner lid attached to the mouth of the bottle and an outer lid pivotably mounted to said inner lid. A drink spout extends from the inner lid. The outer lid may be latched into a closed position covering the drink spout. A push button can be selectively actuated to release the latched outer lid, permitting the outer lid to open to access the drink spout. The push button moves a lid slide containing a catch extension that engages a catch notch in the outer lid to latch the outer lid closed. Actuating the push button moves the catch extension out of engagement with the catch notch, thereby opening the outer lid. A push button lock selectively prevents the push button from being depressed and the lid slide from being actuated, thereby locking the outer lid in a latched and closed position.

8 Claims, 7 Drawing Sheets

BEVERAGE BOTTLE AND LID WITH BACK BUTTON RELEASE AND BUTTON LOCK

FIELD

The present disclosure is directed to a drink bottle having an outer lid attached to an inner lid by a hinge, the outer lid held closed by a moveable extension engaging with a notch in the outer lid and openable by actuating a push button that moves the extension out of engagement with the notch, the push button having a push button lock to prevent actuation of either the push button or moveable extension.

BACKGROUND

Personal beverage bottles are becoming ever more popular and have moved beyond the common beverage bottle packed with a school lunch or in a lunch box. Gyms are filled with members exercising, and many members bring their own beverage bottles for hydration. Hikers, bikers, walkers, commuters, tourists and many others carry beverage bottles as they go on their way. An increasingly common feature of the beverage bottles is a drink nozzle or spout that offers the ability to drink from the bottle without complete removal of the lid from the bottle. Another feature of some drink bottles is a cover for the drink spout or nozzle to keep the spout or nozzle clean between drinking.

SUMMARY

The present invention provides a beverage bottle with a removable lid wherein the lid has an inner lid with a drink spout and an outer lid or cover that is hinged to selectively cover and seal the drink spout. The outer lid may be latched to the inner lid when in the closed positioned. A push button on the inner lid can be operated, when in an unlocked condition (as will be described in further detail below), to release the latched outer lid, permitting the outer lid to open so as to permit drinking from the drink spout. The push button is mounted on a pivot structure and connected on one side to one end of a lid slide. The other end of the lid slide extends to a portion on the inner lid opposite to the hinge and forms a catch extension that engages with a catch notch in the outer lid to hold or latch the outer lid closed. On pressing on one end of the push button towards the radial center of the bottle, the other end of the push button moves away from the radial center of the bottle and pulls the lid slide with it. The catch extension at the end of the lid slide opposite the push button moves out of engagement from the catch notch in the outer lid, thereby permitting the outer lid to open. A push button lock is mated to the lid slide and is configured to selectively lock the lid slide in place, which inhibits the operation of the push button release by removing the user's ability to depress the push button, actuate the lid slide, and/or move the catch extension out of engagement with the catch notch in the outer lid.

In one embodiment, a lid biasing element causes the outer lid to be moved toward the fully open position. The biasing element may be made of a flexible, resilient material that, after being deformed, moves back into its original shape.

In another embodiment of the invention, the lid slide is biased toward a latching position by a deformable portion of the spout that functions as a biasing element so that the catch extension that holds the outer lid in the closed position protrudes into its engagement position except when a release force is exerted on the push button.

BRIEF DESCRIPTION OF THE DRAWINGS

The present invention is described in detail below with reference to the attached drawing figures, wherein.

DETAILED DESCRIPTION

Various embodiments now will be described more fully hereinafter with reference to the accompanying drawings, which form a part hereof, and which show, by way of illustration, specific embodiments. However, this invention may be embodied in many different forms and should not be construed as limited to the embodiments set forth herein. Rather, these embodiments are provided so that this disclosure will be thorough and complete, and will fully convey the scope of the invention to those skilled in the art. The following detailed description is not to be taken in a limiting sense.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments of the invention may be readily combined without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Figure 1:
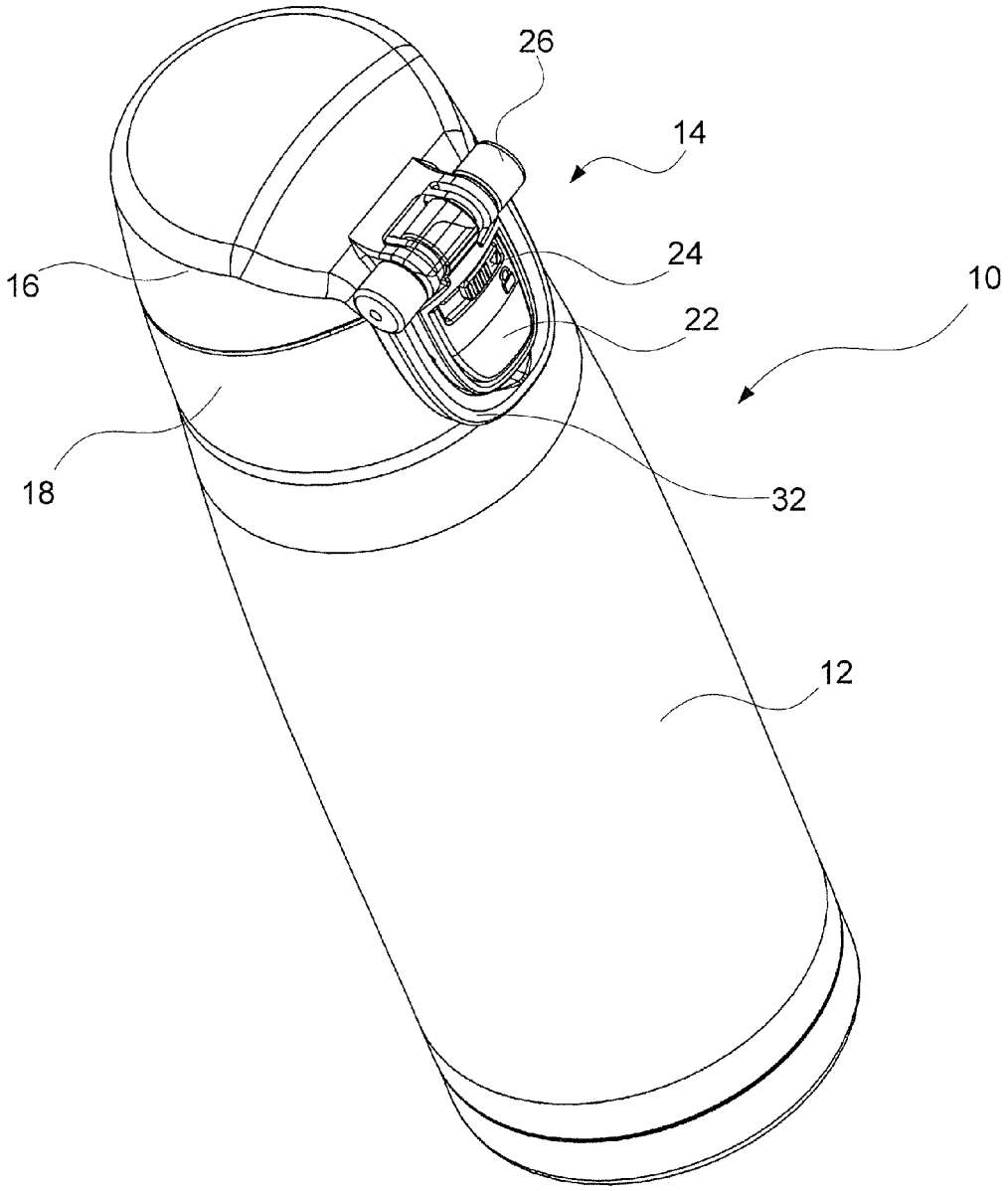
FIG. 1 is a top, rear isometric view showing an embodiment of a drink bottle and lid of the present disclosure.

Referring first to FIG. 1, a beverage bottle 10 includes a bottle body 12 to which is attached a removable lid 14. The bottle body 12 may be of any suitable material, including metal, plastic, glass, rubber and combinations thereof and may be insulated or un-insulated. In the illustrated embodiment, the bottle body 12 is formed from a plastic or other polymer material, which produces a flexible and/or squeezable bottle body 12. In an alternate embodiment, the bottle body 12 may be formed of an insulated stainless steel body part on the bottom of which is fastened a plastic or rubber base (not shown). In yet another embodiment, the bottle body 12 may be of a double-walled construction, between which is an evacuated space, forming a so-called vacuum bottle. The removable lid 14 of the present invention may be used on a flexible bottle, as illustrated, or on a rigid bottle. The flexible bottle permits the user to squeeze the bottle to force the beverage from the bottle, while the rigid bottle requires the user to draw the liquid out of the bottle through suction or by pouring the liquid from the bottle. As disclosed above, the bottle body 12 may include a base that provides protection for the bottom of the bottle body 12 as well as providing a relatively wide surface on which the beverage bottle 10 is rested when standing. The base may be constructed of a plastic material, such as polypropylene, although other materials are of course possible. The bottle body 12 may have a smooth or contoured surface that may be provided with patterns, such as by printing, painting, embossing or otherwise.

Figure 6:
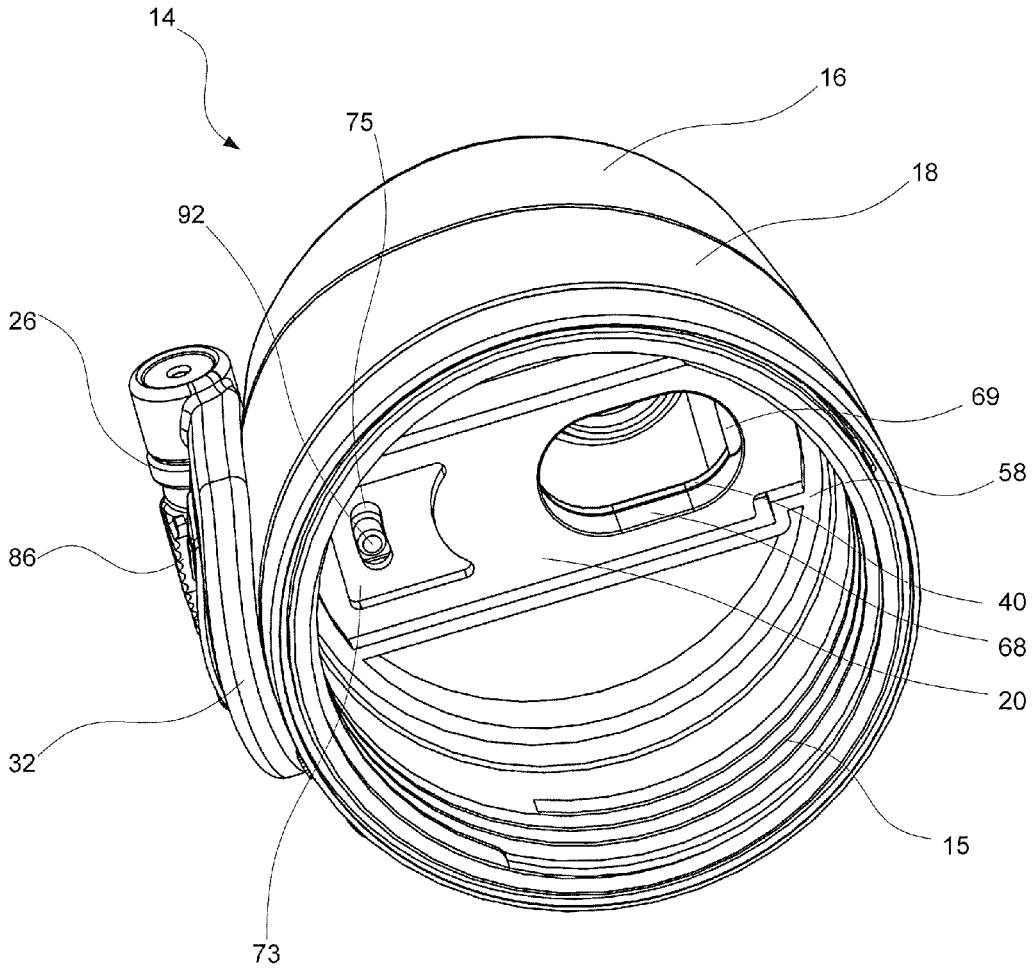
FIG. 6 is a bottom, left side isometric view of an embodiment of a removable lid of the present disclosure, having the lower cover and the combined gasket and drink spout removed.
Figure 9:
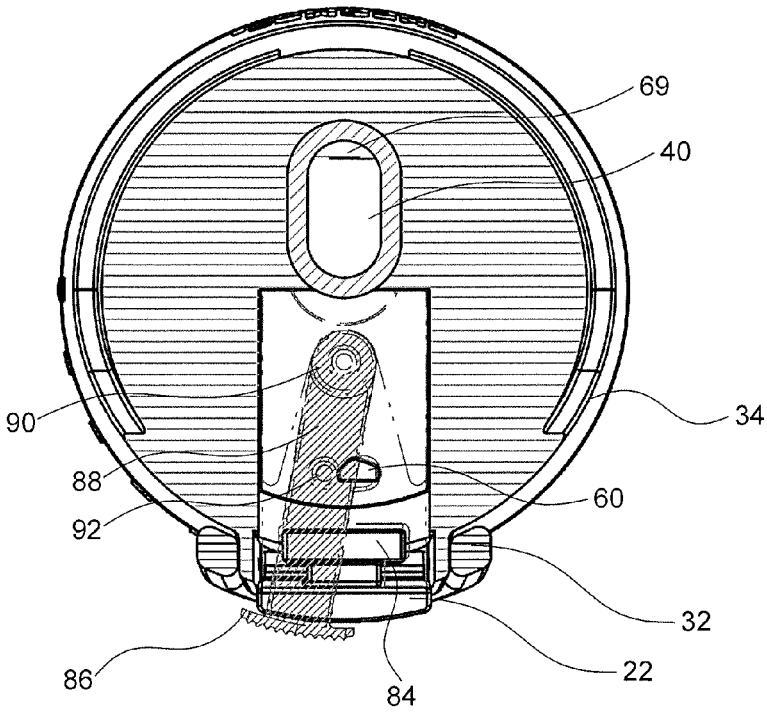
FIG. 9 is a top cross-sectional view of the removable lid of FIG. 4 in the closed position with the push button lock in an unlocked position.

The removable lid 14 may be secured to a mouth (not shown) of the bottle body 12 by a threaded connection, as disclosed in the illustrated embodiment shown in FIGS. 1, 6 and 9. Threads are formed about the mouth (not shown) of the bottle body 12 and complimentary threads 15 are formed within the removable lid 14 so that the lid 14 may be threadably attached to and detached from the bottle body 12. The bottle body 12 may be a narrow-mouth bottle or a wide-mouth bottle. The removable lid 14 depicted in the drawing figures is configured to be used on a wide-mouth bottle. While the above embodiment discloses threaded structures used to attach the lid 14 to the bottle body 12, it should not be read to limit the manner in which the lid 14 may be attached to the bottle body 12. Accordingly, in alternate embodiments, the lid 14 may be attached to the bottle body 12 by alternate attaching or fastening structures, such as a snap-on lid that fits onto a rim on the bottle, a bayonet attachment, or other lid attachment structures.

Figure 2:
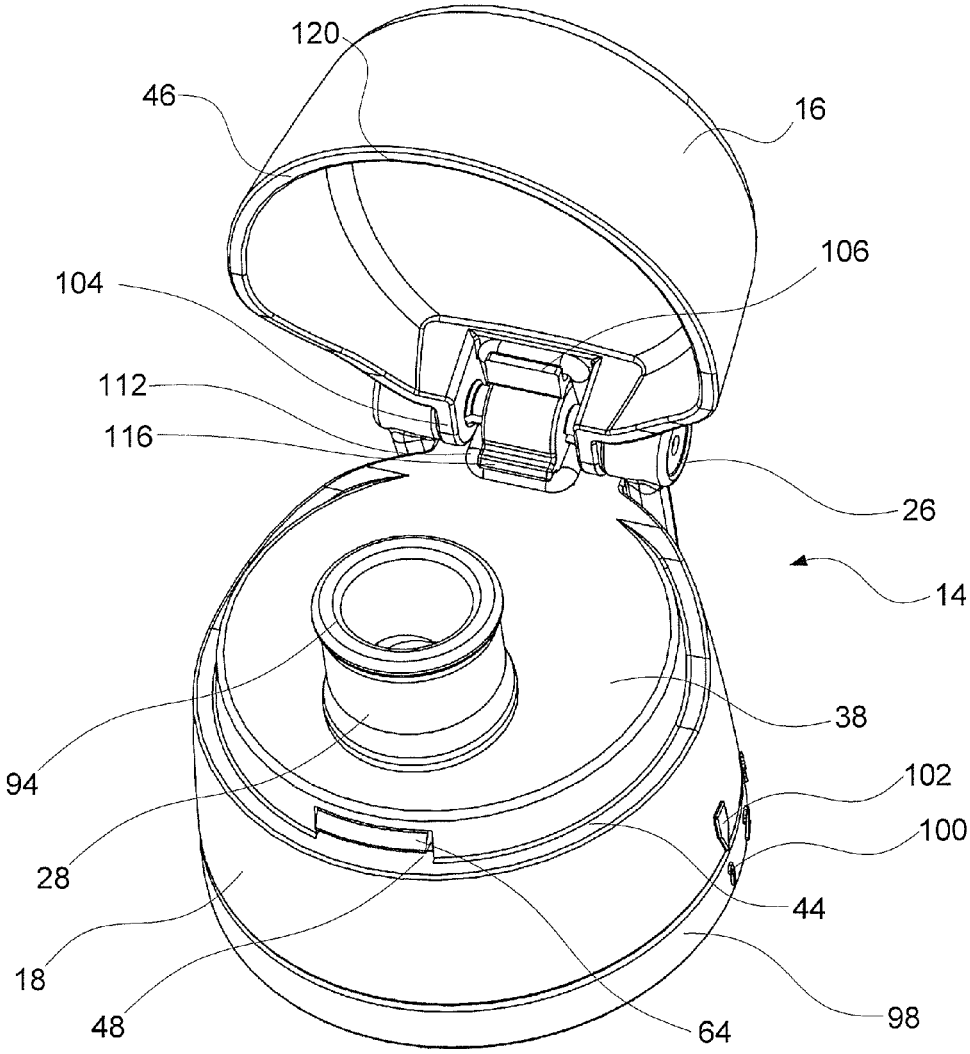
FIG. 2 is a top, front isometric view of an embodiment of a removable lid of the present disclosure.
Figure 3:
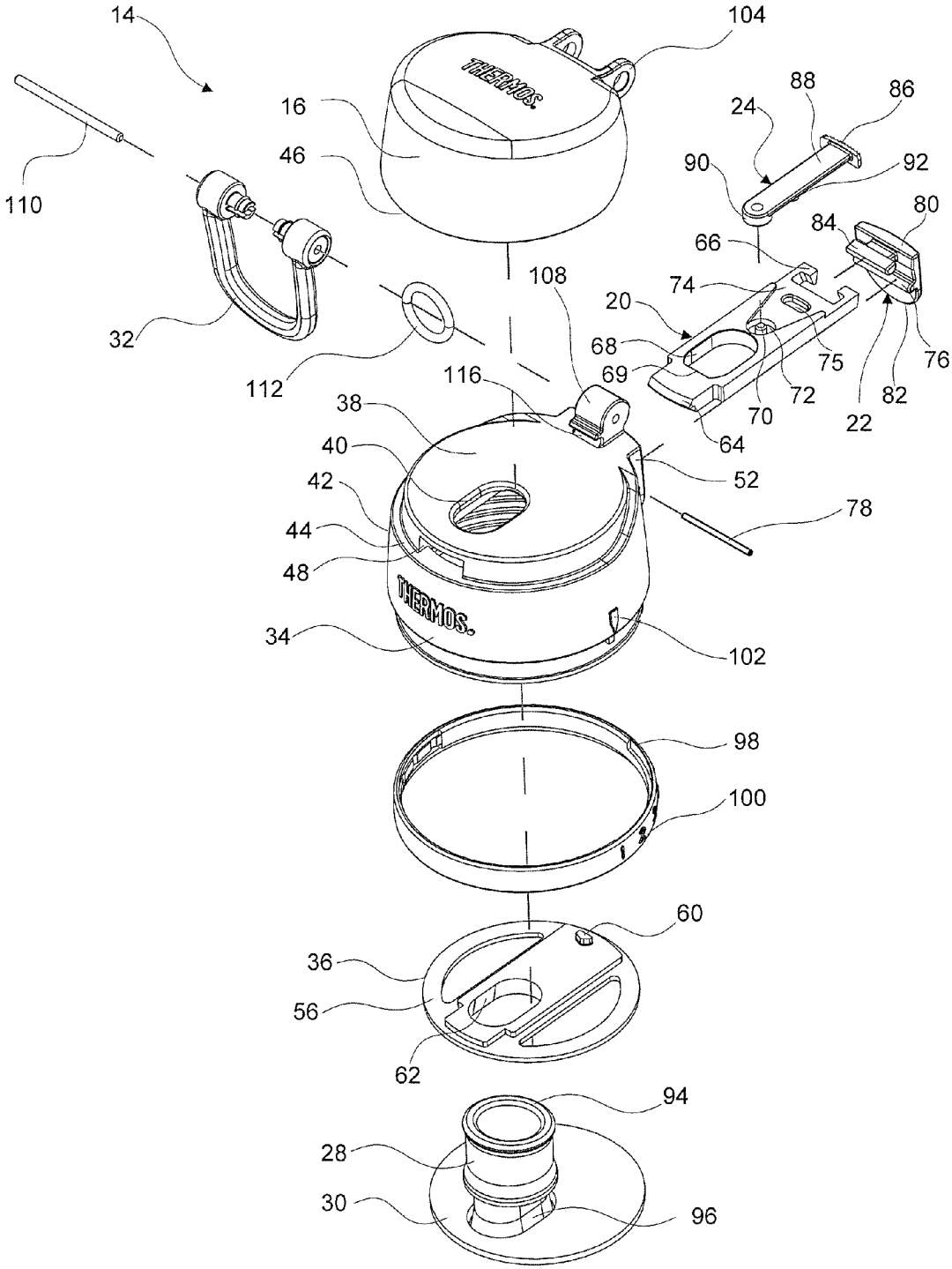
FIG. 3 is an exploded isometric view of an embodiment of a removable lid of the present disclosure including a separate view of an O-ring spring.

Referring to FIGS. 2 and 3, in one embodiment, the removable lid 14 includes: an outer lid 16; an inner lid 18; a lid slide 20 disposed within the inner lid 18; a push button 22 connected to the lid slide 20 for selectively actuating the lid slide 20; a push button lock 24 connected to the lid slide 20 for selectively locking the push button 22 to prevent it from being depressed and to prevent the lid slide 20 from being actuated; and a hinge 26 that connects the outer lid 16 to the inner lid 18. The removable lid 14 further includes a flexible drink spout 28 that has a gasket 30 disposed at a lower end thereof, the drink spout 28 extending through the inner lid 18 such that the gasket 30 is located internal to the inner lid 18. A handle 32 may be attached to the inner lid 18 and/or the outer lid 16 to provide a convenient method of carrying the bottle 10 or attaching the bottle 10 to a backpack, gym bag or the like. In one embodiment, the handle 32 is attached about the outer ends of the hinge 26, thus permitting the handle 32 to be a hinged handle. The handle 32 and outer lid 16 share the hinge 26 so that only one hinge pin need be provided for both elements.

Referring further to FIGS. 2 and 3, the inner lid 18 may be comprised of an upper cover 34 and a lower cover 36. The upper cover 34 may take many different configurations. In one embodiment, the upper cover 34 is primarily shaped as an upside down cup, having a substantially closed top surface 38, except for a spout opening 40 disposed therein, and a cylindrical sidewall 42 extending downward from an outer perimeter thereof. The top surface 38 of the upper cover 34 has a decreased diameter, such that a recessed outer peripheral edge 44 is formed around all, or part, of the outer circumference of the top surface 38.

A catch extension opening 48 is formed in an upper portion of the cylindrical side wall 42 that is perpendicular and adjacent to the recessed outer edge 44 of the upper cover 38. Also disposed in the cylindrical sidewall 42, located radially opposite to the catch extension opening 48, is a push button opening 50 (see FIG. 5), which is surrounded at its perimeter by a push button frame 52. The push button frame 52 serves to aid in properly seating and containing the push button 22 when the removable lid 14 is assembled and protects the button, for example if the bottle is dropped or bumped against an object.

Figure 7:
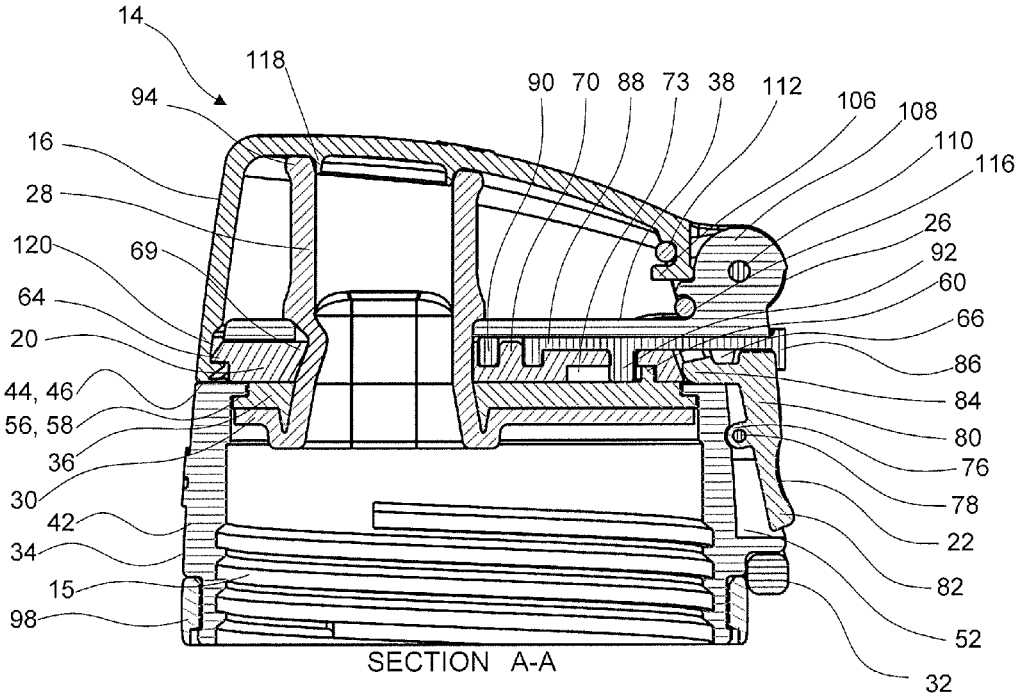
FIG. 7 is a right side cross-sectional view of the removable lid of FIG. 4 having the outer lid in the closed position.
Figure 8:
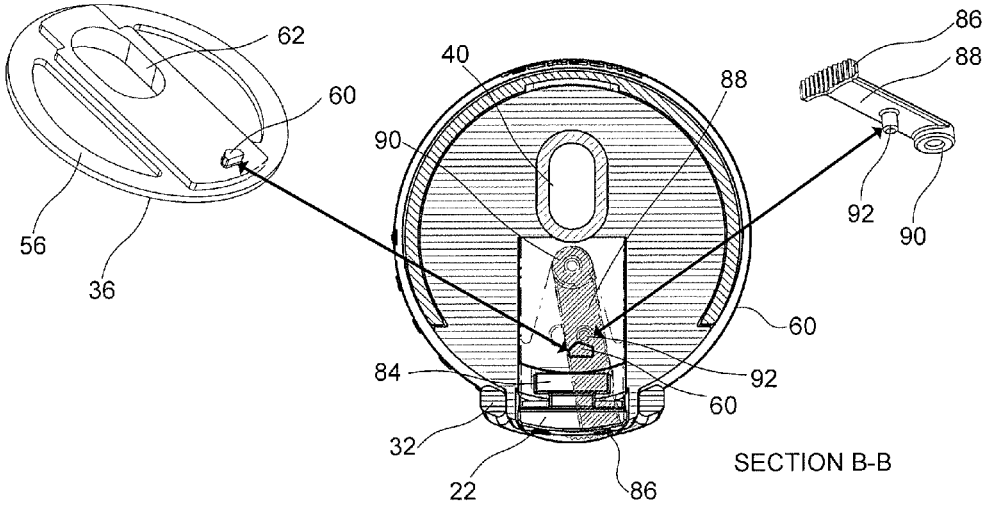
FIG. 8 is a top cross-sectional view of the removable lid of FIG. 4 in the closed position with the push button lock in a locked position including separate views of the locking elements.

Referring to FIGS. 3, 6, and 7, the lower cover 36 of inner lid 18 is located internal to the upper cover 34, such that a perimeter of an upper surface 56 of the lower cover 36 (see FIG. 3) is seated against and/or mated to the internal bottom surface 58 of the recessed edge 44 (see FIGS. 6 and 7), which acts as a stand-off, so as to form a lid slide compartment between the upper cover 34 and the lower cover 36. This lid slide compartment has the catch extension opening 48 disposed in the sidewall 42 at one side of the compartment and the push button opening 50 (see FIG. 5) disposed in the sidewall 42 at the opposite side. The lower cover 36 includes a lower cover protrusion 60 that extends upward from the upper surface 56 of the lower cover 36 and resides inside the compartment between the upper cover 34 and the lower cover 36. The lower cover 36 also includes a lower cover spout opening 62 that is aligned with the spout opening 40 in the upper cover 34.

The lid slide 20 is a slider mechanism that is responsible for keeping the outer lid 16 latched closed when the lid is placed in the closed position. The lid slide 20 is located within the lid slide compartment formed between the mated upper and lower covers 34 and 36, and slidably engages with both the push button opening 50 (see FIG. 5) and the catch extension opening 48 disposed in the upper cover 34. One end of the lid slide 20 contains a catch extension 64 that slidably engages with the catch extension opening 48. The opposite end of the lid slide 20 contains a push button engagement extension 66 that slidably engages with the push button opening 50. Further disposed in the lid slide 20 is a lid slide spout opening 68, that is generally aligned with the spout openings 40 and 62 in both the upper and lower covers 34 and 36, and includes a biasing edge 69 protruding inward into the spout opening 68. The lid slide 20 further includes a bottom recess 73 (see FIGS. 6 and 7) disposed in a bottom surface of the lid slide 20 that provides clearance for, and covers, the lower cover protrusion 60 that, when assembled, extends upward from the upper surface 56 of the lower cover 36 and into the lid slide compartment. The lid slide's bottom recess 73 allows the lid slide 20 to slide over the lower cover protrusion 60 within the slide compartment without making contact with the lower cover protrusion 60. The lid slide 20 further includes a lock hinge pin 70 disposed in a cylindrical recess 72 located in an upper surface of the lid slide 20. The lock hinge pin 70 permits the lid slide 20 to hingeably mate with the push button lock 24. The lid slide also includes a top recess 74 disposed in a top surface of the lid slide 20, into which the push button lock 24 will be seated when mated thereto, such that the top surface of the push button lock 24 does not protrude much higher, if at all, above the top surface of the lid slide 20. This will help to ensure that the lid slide 20 and mated push button lock 24 will have a consistently smooth sliding action within the lid slide compartment. The lid slide further includes a lock protrusion opening 75 that creates a passage between the bottom recess 73 and the top recess 74 of the lid slide 20.

The push button 22 is a button that is used to actuate the lid slide 20 to open the outer lid 16. The push button 22 includes a pivot connection 76 that holds the push button 22 within the push button frame 52 by a pivot pin 78 that is slidably engaged through complimentary holes located in both the frame and pivot connection 76. Pivot connection 76 and mated pivot pin 78 divide the push button 22 into an upper end 80 and a lower end 82 thereby allowing a rotational rocking movement of the push button 22 around the pivot connection 76. In this manner, the push button 22 acts as a lever. A slide engagement extension 84 extends from the upper end 80 of the push button 22 and engages with the push button engagement extension 66 located at the end of the lid slide 20. With the slide engagement extension 84 mated with the push button engagement extension 66 of the lid slide 20, the push button 22 can pivot about the pivot connection 76 to pull on the push button engagement extension 66 of the lid slide 20, thereby slidably actuating the lid slide 20, as well as the extension and retraction of the catch extension 64 from within the catch extension opening 48 located at the opposite end of the lid slide 20.

Referring to FIGS. 3-9, in one embodiment, the push button lock 24 is a locking lever that serves to place the push button 22 and the lid slide 20 in either a locked or unlocked condition. The locked condition prevents the push button 22 from being depressed and the catch extension 64 at the end of the lid slide 20 from retracting back into the catch extension opening 48 in the upper cover. The unlocked condition permits a user to depress the push button 22, thereby actuating the lid slide 20, and retracting the catch extension 64 back into the catch extension opening 48. Referring to FIG. 3, the push button lock 24 has a knurled thumb switch 86, a lever arm 88 connected at one end to the thumb switch, a lock hinge cylinder 90 connected to the opposite second end of the lever arm 88, and a push button lock protrusion 92 disposed on the lever arm between the thumb switch and hinge cylinder and extending downward from the lever arm 88. The push button lock 24 is mated to the lid slide 20 by the insertion of the lock hinge cylinder 90 over the lock hinge pin 70 disposed on the lid slide 20, and the insertion of the lock protrusion 92 into the lock protrusion opening 75 in the lid slide 20 (see FIGS. 3 and 6-10).

Referring to FIGS. 2, 3, 7, and 10, the flexible drink spout 28 is the spout through which a user accesses and removes fluids held in the assembled beverage bottle 10. The spout 28 is formed from a pliable material, such as a food-grade silicon rubber that flexes and bends readily. The flexible drink spout 28 may be comprised of a short drinking tube that extends from an open top end, or mouth 94, which mouth is located external to the inner lid 18, through the spout openings 40, 62, and 68 in each of the upper cover 34, lid slide 20, and lower cover 36, and is connected at a bottom open end 96 to the gasket 30. The gasket 30 is thus located internal to the inner lid 18 and is seated against a bottom surface the lower cover 36. The diameter of the gasket 30 is approximately the same as that of the lower cover 36 and is otherwise configured to be large enough to cover the mouth of the bottle body 12 to which the removable lid 14 will be attached. The drink spout 28 provides user access to the fluid or beverage held within the interior of body bottle 12, when the bottle 10 is fully assembled As disclosed previously, the inner lid may further include threads 15 formed within or on the lower interior surface of the sidewall 42, as shown in FIGS. 6 and 7, for mating with complimentary threads (not shown) disposed about the mouth of the bottle body 12. In one embodiment, referring to FIGS. 2-7, the removable lid 14 may also optionally include a drink counter that is comprised of a rotating dial 98 disposed on the exterior surface of the open bottom end of the sidewall 42 of the inner lid 18. The dial 98 includes a plurality of sequential numbers 100, beginning with the number "1", disposed thereon. Adjacent to the rotating dial 98 and disposed on or in the outer surface of the sidewall 42 is a dial indicator 102, such as a raised or recessed dot, hash mark, or arrow. In alternate embodiments, the dial indicator 102 can also be a marking made with ink, paint, or other applied markings, or any combination of raised protrusions, recesses, or markings. The rotating dial can be rotated such that each number will sequentially align with the dial indicator. The dial is intended to allow users of the bottle 10 to keep track of the number of bottles of fluid they have drank in a given time period, such as the number of bottles of water a user has drank during a given day. However, it is to be understood that alternate configurations of the drink dial are contemplated as being within the scope of this disclosure, such as a drink dial containing markings permitting a user to track the total number of ounces, or other fluid volume measurements, consumed. Further still, in additional alternate embodiments of the inner lid 18 a rotating dial and complimentary indicator, as disclosed above, is not present. Rather, in alternate embodiments the inner lid 18 does not include any drink counter of any type.

Referring to FIGS. 3-5, 7 and 10, the outer lid 16, similar to the inner lid 18, is generally cup-shaped and has a closed top end and generally cylindrical sidewall(s) extending downward therefrom, ending in the substantially open circumferential lower edge 46 that mates with the recessed edge 44 of the inner lid 18, when the lid is in a closed position. The outer lid 16 further includes a pair of outer lid hinge tabs 104 disposed on the outer surface of the outer lid 16 and a lid biasing element retention hook 106 extending from an inner surface of the outer lid 16. Complimentary to the lid hinge tabs 104 is an inner lid hinge barrel 108 that is integrally connected to the top surface 38 of the inner lid 18. The lid hinge tabs 104 are positioned on either side of hinge barrel 108 and a hinge pin 110 is disposed through a center pin hole in the hinge tabs 104 and the mated hinge barrel 108 to form the lid hinge 26. In one embodiment, a "U" shaped handle 32 having handle hinge barrels disposed at each end of the "U" shape is positioned such that the handle hinge barrels are generally located on the outsides of the lid hinge tabs 104. A hinge pin 110 is inserted through the handle hinge barrels, the lid hinge tabs 104, and the hinge barrel 108, so as to form the hinge 26 for the lid, as well as a hinged handle.

Referring to FIG. 7, the outer lid further includes a spout seal 118 for sealing the open mouth 94 of the spout 28 when the outer lid 16 is in a closed position. The shape of the spout seal 118 is complimentary to the shape of the mouth 94 of the spout 30, such that when the outer lid 16 is closed, the spout seal 118 mates with the mouth 94 of the spout 28. In one embodiment, the mouth 94 of the spout 28 is circular in shape and the spout seal 118 is in the form of a complimentary-shaped raised circular ring that extends or protrudes from the inner top surface of the outer lid 16 and has an outer side wall that is tapered from the base of the protruding ring toward the center of the ring. The taper permits the protruding end of the spout seal 118 to be guided inside of the mouth of the spout 28 when the outer lid 16 is closed, while the tapered sides of the spout seal 118 apply a force sufficient to provide a liquid tight seal against the internal edges of mouth 94 of the spout 28, when the spout seal 118 is fully seated upon closing of the outer lid 16. The compression forces applied to the lid by the spout may cause the lid to open when the latch is released. In addition, the outer lid 16 includes a catch notch 120 that is disposed on the interior surface of the circumferential lower edge 46 near the bottom of the outer lid 16. Lastly, the outer lid 16 may also include structures (not shown) to help guide the spout 28 such that it will be properly seated against or around the spout seal 118 when closing the outer lid 16.

Referring to FIGS. 2-5, the removable lid 14 further includes a lid biasing element 112 that is disposed around the biasing element retention hook 106 on the interior of the outer lid 16, passes through a pair of outer lid slots 114 disposed in the outer lid 16 between the hinge tabs 104, passes between each end of the hinge pin 110 and the top surface 38 of the inner lid 18, and is retained in a biasing element retention slot 116 disposed at the base of the hinge barrel 108 on the inner lid 18. In its free state, lid biasing element 112 takes the shape of an O-ring and is made of a flexible material that is resilient, such as rubber or silicone, and biases the outer lid 16 toward the fully open position by exerting tension forces on both the retention hook 106 from the outer lid 16 and the retention slot 116 from the inner lid 18. When the outer lid 16 is in the closed position, the lid biasing element 112 is stretched and bent almost 180-degrees back on itself as it extends from the biasing element retention slot 116 and around the ends of the hinge pin 110 to connect with biasing element retention hook 106. Since lid biasing element 112 is stretched, it exerts tension forces that cause the outer lid 16 to move toward the open position and to be retained there when the outer lid 16 is unlatched and free to move about the hinge 26. In alternate embodiments, the lid biasing element 112 may be made of other suitable materials and have other configurations that provide similar functionality. The biasing element 112 may provide the primary force for moving the outer lid 16 to the fully open position, or the outer lid 16 may be moved toward the fully open position by the user and retained there by the biasing element 112. The force of the biasing element 112 on the outer lid 16 may be easily overcome by the user in order to move the outer lid 16 to the closed position.

Referring to FIGS. 3, 6, and 7, to assemble the removable lid 14 the push button lock 24 is mated with the lid slide 20 by inserting the lock protrusion 92 on push button lock 24 into the lock protrusion opening 75 in the lid slide 20, and mating the lock hinge cylinder 90 of the push button lock 24 with the lock hinge pin 70 on the lid slide 20. When these two components are mated, the lock protrusion 92 protrudes downward through the protrusion opening 75 in the lid slide 20 and into the bottom recess 73 of the lid slide 20. Next, the push button 22 is mated with the lid slide 20 by engaging the slide engagement extension 84 on the push button 22 with the push button engagement extension 66 at the end of the lid slide 20. The assembled lid slide 20, push button lock 24, and push button 22 are then assembled into the upper cover 34, by inserting the end of the lid slide 20 with the catch extension 64 into the push button opening in the sidewall 42 of the upper cover 34 until the catch extension protrudes through the catch extension opening 48 and the push button is fully seated into the push button frame 52. The pivot pin 78 is then inserted through the push button frame 52 in the upper cover 34 and the push button 22 to hingeably connect them together and prevent the removal of the push button 22, lid slide 20, and push button lock 24. In this condition, the spout openings 40 and 68 in both the lid slide 20 and the upper cover 34 are aligned.

Referring Further to FIGS. 3 and 7, the lower cover 36 is next inserted into the upper cover 34 from the open bottom end of the upper over 34 such that (1) the lower cover spout opening 62 is aligned with the spout openings 68 and 40 in both the lid slide 20 and the upper cover 34, and (2) the lower cover protrusion 60 is directed upward and protrudes into the bottom recess 73 of the lid slide 20. Accordingly, both the lower cover protrusion 60 and the push button lock protrusion 92 now reside in the space defined by the bottom recess 73 in the lid slide 20. Depending on the positioning of the push button lock 24, the lower cover protrusion 60 may selectively interfere with the free linear movement of the push button lock protrusion 92 when attempting to depress the push button to slidably actuate the lid slide 20. The lower cover 36 is further seated in place such that a perimeter of the upper surface 56 of the lower cover 36 is seated against and/or mated to the internal bottom surface 58 of the recessed edge 44 of the upper cover 34. The properly seated lower cover 36 may be permanently affixed to the upper cover 34 by, for example, sonic welding the lower cover 36 to the upper cover 34, or other such known techniques. Various seals may also be used to prevent liquids from passing between the various components that form the inner lid 18. In alternate embodiments, the lower cover 36, gasket 30, and spout 28 may be manufactured so as to form a single-piece lower cover 36. The spout can be installed now or later as described hereinafter.

Referring to FIGS. 3-5 and 7, the handle 32 may be optionally mated to the outer lid 16 so that integral guide pins at the ends of the "U" shaped handle are seated inside the hinge tabs 104 of the outer lid 16. The outer lid hinge tabs 104 are next aligned with each end of the inner lid hinge barrel 108. The lid biasing element 112 is inserted into the biasing element retention slot 116 at the base of the inner lid hinge barrel 108 of the inner lid 18, through the outer lid slots 114, and stretched over the biasing element retention hook 106 in the outer lid 16. The lid hinge pin 110 is then inserted into the aligned hinge components, such that the biasing element 112 passes between the hinge pin 110 and the top surface 38 of the inner lid 18. The rotating dial is also snapped in place at the bottom of the inner lid 18.

Lastly, the combined spout 28 and gasket 30 are installed in one of two ways. In a first way, the disk-shaped gasket 30 is folded or rolled and is stuffed from above through the spout openings 40, 68, and 62 in the upper cover, lid slide, and lower cover respectively. Once the gasket 30 is through the spout openings, it is pulled to seat the spout 28 in place and the gasket 30 is flattened within the inner lid so that it is seated against the lower cover 36 to form a seal over the mouth of the bottle. In a second way, the spout 28 is inserted from the open bottom end of the inner lid 18 upwards through the spout openings 62, 68, and 40 of each of the lower cover 36, the lid slide 20, and the upper cover 34, until the gasket 30 is properly seated against the bottom surface of the lower cover 36 and the spout 28 fully extends through the spout opening 40 in the upper cover 34. With the removable lid fully assembled, a user may proceed to use the bottle 10. While the above disclosure provides for various steps to assemble the removable lid 14 and bottle 10, it should be understood the various assembly steps may be performed in a different order than those disclosed above, or fewer or additional assembly steps may be performed, depending on the specific configuration of the removable lid and bottle.

In operation, the bottle functions as follows. In one embodiment, with the removable lid 14 in a closed position, the user removes the removable lid 14 from the bottle body 12, for example, by unscrewing the threads 15 on the inner surface of the sidewall 42 of the lid 14 from the threads disposed on the outer surface of the bottle neck (not shown). After the user fills the bottle with the chosen beverage, the lid 14 is re-attached to the bottle body 12. When the removable lid 14 is attached to the bottle body 12, the gasket 52 covers the mouth of the bottle body 12 and is sandwiched between the top surface of the mouth of the bottle and the bottom surface of the lower cover 36 of the removable lid 14 with sufficient force to provide a liquid tight seal between the mouth of the bottle and the gasket 30. This liquid tight seal prevents fluid from leaking out of the assembled beverage bottle 10 at the mating surfaces of the bottle body 12 and removable lid 14, and only permits fluid to exit the assembled bottle 10 through the spout 28 when the outer lid 16 is in an open position.

Referring to FIG. 7, when the outer lid 16 is in a closed position, a circumferential lower edge 46 of the outer lid 16 mates with the recessed edge 44 on the upper cover 34 of the inner lid 18 so as to shield the top surface 38 of the inner lid 18 from dirt and contamination and to enclose the spout 28 within the interior of the outer lid 16. Furthermore, in the closed position the outer lid 16 seals the mouth 94 of the spout 28 by mating the spout seal 118 into and against the open mouth 94 of the spout 28. When the spout seal 118 and mouth 94 of the spout are mated, the inner surface of the mouth 94 of the spout 30 is stretched slightly around the tapered outer surface of the mated spout seal 118. This ensures that when the outer lid 16 is closed, there is sufficient force between the tapered outer surface of the spout seal 118 and the inner surface of the mouth 94 of the spout 28 to form a liquid tight seal with the mouth 94 of the spout 28, thus preventing any liquid from escaping from within the bottle 10 while the outer lid 16 is closed. The outer lid is kept in the closed position over the inner lid 18 by the engagement of the catch extension 64, which is located at the end of the lid slide 20 and generally protrudes from the catch extension opening 48 in the inner lid 18, with the catch notch 120 disposed in the outer lid 16. While the illustrated embodiments show a notch in the outer lid and an extension on the end of the lid slide, in alternative embodiments, alternative structures may be utilized for maintaining the lid in a closed position, such as reversing the locations of the notch and extension, or use of other mechanical or magnetic locking mechanisms and features.

Figure 4:
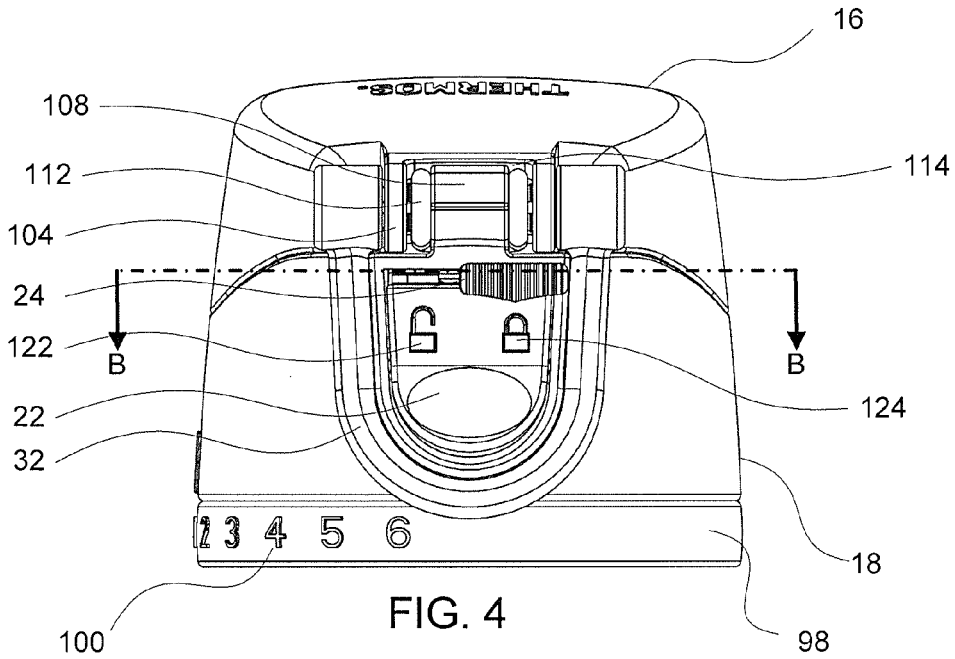
FIG. 4 is a back elevation view of an embodiment of a removable lid of the present disclosure, showing a handle, push button, a push button lock in a locked position, and an outer lid in a closed position.
Figure 5:
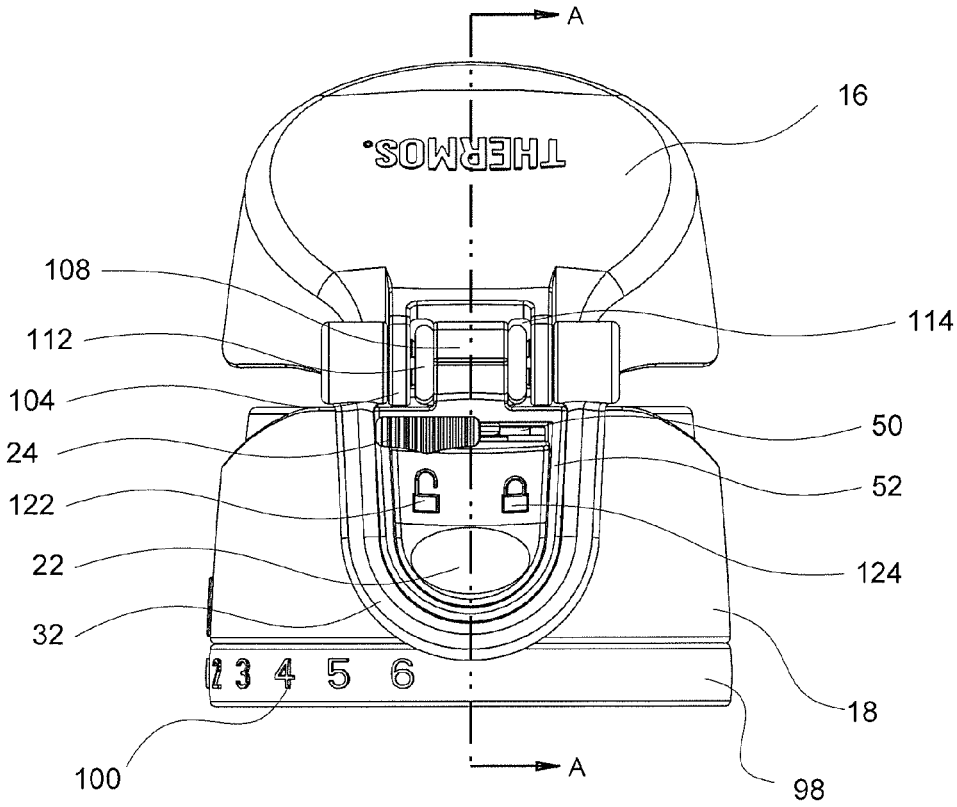
FIG. 5 is a back elevation view of an embodiment of a removable lid as shown in FIG. 4, showing the push button lock in an unlocked position and the outer lid in an unlatched and partially open position, including section line A-A along which the cross sections of FIGS. 6 and 9 are taken.

Referring to FIGS. 4, 5, and 7-9, to open the removable lid 14 and gain access to the beverage contained in the bottle 10, the push button lock 24 must first be placed into an unlocked position, which in one embodiment corresponds to the thumb switch 86 being rotated to the left side of the push button 22 above the icon depicting an unlocked padlock 122 (see FIG. 5). This in turn rotates the lever arm 88 of the push button lock 24 clockwise (when viewed from in a top-down view) and moves the attached push button lock protrusion 92 out of alignment with the lower cover protrusion 60, so that when the lid slide is actuated, the push button lock protrusion will slide with the lid slide 20 without making contact with the lower cover protrusion 60 (see FIG. 9) that remains stationary. With the push button lock 24 in the unlocked position, the user is able to push on the lower end 82 of the push button 22 towards the radial center of the removable lid 14. Pushing on the button 22 rotates the push button 22 about the pivot connection 76 and causes the upper end 80 of the push button 22, as well as the slide engagement extension 84 extending from the upper end 80 of the push button 22, to move radially outward. The slide engagement extension 84 on the push button 22 thus pulls on the mated push button engagement extension 84 at the end of the lid slide 20 in the same direction. This motion in turn actuates the lid slide 20, causing the catch extension 64 disposed at the opposite end of the lid slide 20 (1) to slidably be retracted into the inner lid 18 through the catch extension opening 48, and (2) to disengage from the catch notch 120 in the outer lid 16, which releases the outer lid 16 from the closed and latched position so that it may move to the open position. The removable lid is shown in cross section in FIG. 10 depicting the push button 22 in a depressed condition, the connected lid slide 20 in the slidably actuated and retracted position, and the outer lid 16 shown in the open position.

Figure 10:
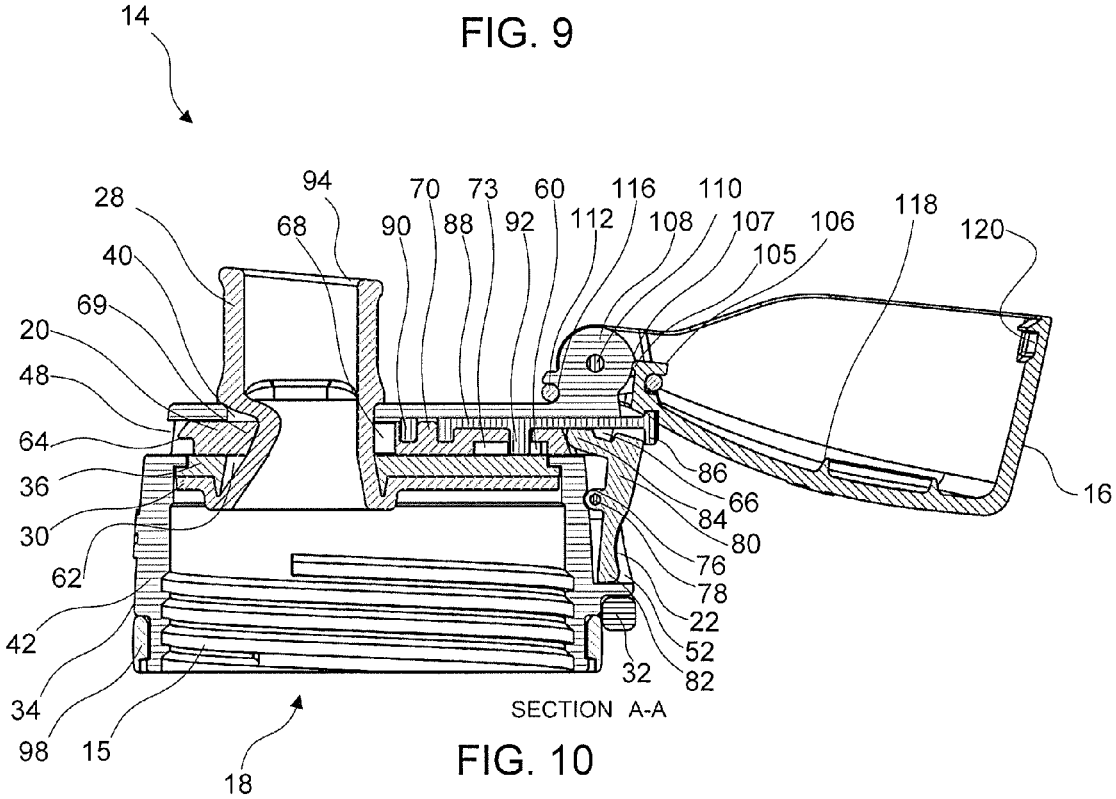
FIG. 10 is a right side cross-sectional view of the removable lid of FIG. 4 having the outer lid in the fully open position with the push button in a depressed position, the lid slide actuated, and the catch extension retracted.

Referring to FIGS. 7 and 10, generally, the catch extension 64 disposed at an end of the lid slide 20 extends through and protrudes from the catch extension opening 48, except when the push button 22 is depressed and causes the catch extension 64 to be pulled into catch opening 48. When the push button 22 is released, the catch extension 64 is automatically biased back into its previous state/position and again protrudes from within the catch extension opening 48. To achieve the automatic return of the catch extension to its protruding position, the flexible spout 28 that passes through the spout openings 62, 68, and 40 in each of the lower cover 36, the lid slide 20, and the upper cover 34 acts as a biasing element on the lid slide, forcing the catch extension on the lid slide to protrude from the catch extension opening in the upper cover. The biasing is achieved as a result of the reactionary force from the side wall of the drink spout 28, after the sidewall of the spout 28 is depressed slightly inward toward a center of the spout 28 by the biasing edge 69 of the lid slide spout opening 68. At all times, the biasing edge 69, which is disposed in the lid slide spout opening 68 nearest the catch extension 64, applies a slight force against the sidewall of the flexible drink spout 28 passing there through, causing the sidewall to indent inward toward the center of the drink spout at the location of the biasing edge 69. This in turn causes the sidewall of the spout 28 to apply a force in the opposite direction, back against the biasing edge 69 of the lid slide 20 and toward the catch extension 64 on the lid slide 20 and catch extension opening 48 in the upper cover 34. Accordingly, in this manner, the spout 28 also acts as a biasing mechanism for the outer lid latching mechanism to keep the catch extension 64 biased to protrude from the catch extension opening 48 without requiring an additional biasing element. Thus, catch extension 64 can be moved out of engagement with the catch notch 120, but is biased back into its original position by the spout 28 applying a force on the lid slide 20.

Referring to FIGS. 2, 4, and 7, when the outer lid is in a closed position, the lid biasing element 112 is stretched around the hinge pin 110 and is at all times under tension, which is in turned transferred to the biasing element retention slot 116 of the inner lid 18 and the biasing element retention hook 106 of the outer lid 16. When the push button is depressed and the catch extension is disengaged from the catch notch in the outer lid, the tension in the lid biasing element 112, as applied to both the biasing element retention slot 116 of the inner lid 18 and the biasing element retention hook 106 of the outer lid 16, causes the outer lid 116 to automatically rotate on its own into an open position, where some of the tension in the lid biasing element 112 is relieved. The outer lid 16 may be held in this open position by the remaining tension in the lid biasing element 112.

Referring to FIG. 10, when the outer lid 16 is in the fully open position, a projection 105 extending from the back of the biasing element retention hook 106 on the outer lid 16 bears against the inner lid hinge barrel 108 and catches on a ridge 107 on the hinge barrel 108 to retain the outer lid 16 in the open position.

With the outer lid in the open position, the spout seal 118 in the outer lid 16 is rotated away from the mouth 94 of the drink spout 28 and the drink spout 28 is open and accessible to the user. The user may drink from the bottle 10 by tipping the top of the bottle, and accordingly, the mouth 94 of the spout 28 toward him, like a drinking glass or typical soda bottle, and sipping the beverage from the mouth 94 of the spout 28 as it exits through the spout 28. In the case of flexible bottle bodies 12, the user may drink from the bottle 10 by squeezing the bottle body 12 and forcing the beverage out through the spout 28 into the user's mouth, or by a combination of both aforementioned techniques. When the user drinks through the drink spout 28, the liquid passes from within the bottle body 12 over the fluid tight gasket 30, into the bottom end 96 of the spout 28 that is connected to the gasket 30, and out the mouth 94 of the spout 28. If the present lid is to be used on a flexible squeeze bottle body 12 in which the user squeezes the bottle to force the beverage from the drink spout 28, as disclosed above, no venting holes are needed. In addition, if the present lid is to be used with rigid bottle configurations, because of the larger diameter of the drink spout 28 and the ability to sip on one side or edge of the spout 28, leaving an air gap between the user's upper lip and the opposite side of the spout, no separate venting hole is needed.

However, in still alternate embodiments (not depicted), the removal of liquid from the bottle 10 may cause a negative air pressure within the bottle 10, especially for rigid bottle configurations in which the spout may be completely covered by the mouth of a user. In such embodiments, it is contemplated that a vent hole may be optionally provided through the inner lid, through which air may flow into the bottle to prevent the buildup of such negative pressure, thereby making drinking from the bottle easier. Such a vent hole would be sealed off upon closing of the outer lid 16 to prevent fluid from leaking there through when the outer lid 16 is in the closed position. In such an embodiment, sealing the vent hole when the outer lid 16 is closed helps prevent leaking of the liquid from the drink bottle 10, for example when the bottle is stored on its side such as when placed into a school locker or gym bag. When the outer lid 16 is opened, the vent hole is unsealed, permitting the flow of air into the interior of the bottle 10 when a user drinks from the spout 28.

Referring to FIGS. 4-5 and 7-10, to close the outer lid 16, the user rotates the lid about hinge 26 until the catch notch 120 in the outer lid 16 re-engages with the catch extension 64 protruding through the catch extension opening 48 in the inner lid 18. If the user wants to ensure that the push button 22 won't be accidentally depressed at an inopportune time, say for example when the bottle is laying on its side while inside a backpack or other bag, he can rotate the push button lock 24 to a locked position, which in one embodiment corresponds to the thumb switch 86 being slidably rotated to the right side of the push button 22 above the icon depicting a locked padlock 124 (see FIG. 4). This in turn rotates the lever arm 88 of the push button lock 24 counterclockwise (when viewed from in a top-down view) and forces the attached push button lock protrusion 92 to slip behind the lower cover protrusion 60, such that the push button lock protrusion 92 is placed in direct contact with, and in radial alignment with, the stationary lower cover protrusion 60 (see FIG. 8). With the two protrusions 92 and 60 in direct contact and alignment with each other, relative to the sliding direction of the lid slide 20, when the user attempts to depress the push button to actuate the lid slide 20, the lower cover protrusion 60 interferes with the sliding movement of the push button lock protrusion 92 that would otherwise move with the lid slide 20, thus preventing any movement or actuation of the lid slide 20, and accordingly, any movement of the push button 22. Thus, when the push button lock 24 is in the locked position, it is not possible to either depress the push button 22 or actuate the lid slide 20, and therefore, the catch extension 64 cannot disengage from the catch notch 120 and the outer lid 16 will remain in the closed and latched position.

The outer lid 16 and inner lid 18 are of polypropylene in one embodiment, but may be made of any number of plastics such as PET, HDPE, LDPE or other polyesters. The release button 22 may be of polypropylene or another material. As noted above, the drink spout 28 is made of silicone rubber. Other materials are of course possible and are encompassed within the scope of the present invention.

Thus, there has been shown and described a drink bottle having a removable lid that has a drinking spout and a lockable cover or outer lid over the drinking spout. Although other modifications and changes may be suggested by those skilled in the art, it is the intention of the inventor to embody within the patent warranted hereon all changes and modifications as reasonably and properly come within the scope of his contribution to the art.

What is claimed is:

1. A drink bottle and lid, comprising:

a bottle having a mouth with a lid engaging structure;

a removable lid having a cooperating engaging structure for selective engagement with the lid engaging structure of the bottle;

the removable lid including an inner lid and an outer lid, the inner lid including the cooperating engaging structure, the inner lid defining a spout opening, the inner lid including a first hinge portion;

the outer lid including a catch notch and a second hinge portion for pivoting engagement with said first hinge portion so that said outer lid is pivotable relative to said inner lid between an open position and a closed position;

a push button having a pivot such that actuating one end of the push button radially inward towards a center line of the bottle causes a second end of the push button to move radially away from the center line of the bottle;

a lid slide moveable between an outer lid-latching position and an outer lid-releasing position, the lid slide having a first end and a second end, the first end of the lid slide coupled to the second end of the push button through a push button opening, and the second end of the lid slide having a catch extension for engagement with the catch notch of the outer lid;

a push button lock connected to said lid slide and moveable between a locked position and an unlocked position, the push button lock preventing the movement of said lid slide from the lid-latching position to the lid-releasing position when in the locked position, and the push button lock permitting movement of said lid slide from the lid-latching position to the lid-releasing position when in the unlocked position;

a drink spout mounted in said spout opening of said inner lid, said drink spout extending from said inner lid at a position to permit a user to drink fluid contained within the bottle from said drink spout when said outer lid is in the open position, said outer lid covering said drink spout when said outer lid is in said closed position, said drink spout configured to bias the lid slide into the lid-latching position, wherein actuating the push button causes the lid slide to move to the lid-releasing position in opposition to a biasing action of said drink spout; and a lid biasing element coupled between the inner lid and the outer lid to bias the outer lid into the open position.

2. A drink bottle and lid as claimed in claim 1, wherein said lid biasing element is an O-ring.

3. A drink bottle and lid as claimed in claim 1, wherein the drink spout is a tube having a central axis, an open top end, an open bottom end, and a flexible tubular sidewall disposed between the top end and the bottom end, the top end defining a mouth of the drink spout, the bottom end connected to a gasket extending outwardly therefrom, said drink spout mounted within said spout opening of said inner lid such that said bottom end of the drink spout and said connected gasket are both located in an interior of said inner lid, and said mouth of said drink spout is exterior to and extends from said inner lid.

4. A drink bottle and lid as claimed in claim 3, wherein the lid slide is configured to force said tubular sidewall of said drinking spout to deflect inward toward the central axis of the spout and away from the catch extension when the lid slide is in the lid-latching position, said lid slide being biased into the lid-latching position by the application of a force by the deflected tubular sidewall against said lid slide, in the direction of the catch extension and away from said central axis.

5. A drink bottle and lid as claimed in claim 1, wherein the drink spout passes through a lid slide spout opening disposed in the lid slide.

6. A drink bottle and lid as claimed in claim 1, further comprising:

a handle coupled to the inner lid.

7. A drink bottle and lid as claimed in claim 1, further comprising:

a spout seal disposed on an interior surface of the outer lid, wherein when the outer lid is in the closed position a mouth of the drink spout that is disposed at a top end of said drink spout is substantially sealed by the spout seal.

8. A drink bottle and lid as claimed in claim 1, further comprising:

a rotating dial disposed about an outer surface of said inner lid and containing numerical markings thereon; and a dial indicator adjacent said rotating dial for marking the position of the rotating dial.

* * * * *